US005353014A

United States Patent [19]

Carroll et al.

[11] Patent Number: 5,353,014

[45] Date of Patent: Oct. 4, 1994

[54] CIRCUIT BREAKER WITH INDICATOR LIGHTS

[76] Inventors: John T. Carroll, 68 Coldcliff Rd., Malden, Mass. 02148; Raymond W. Dunbrack, 35 Webster St., #3, Everett, Mass. 02149

[21] Appl. No.: 874,409

[22] Filed: Apr. 27, 1992

[51] Int. Cl.[5] ..... G08B 21/00

[52] U.S. Cl. ..... 340/638; 340/644; 335/17

[58] Field of Search ..... 340/638, 635, 639, 644; 335/17; 200/308

[56] References Cited

U.S. PATENT DOCUMENTS 4,004,201 1/1977 DePuy ..... 340/638

4,969,063 11/1990 Scott et al. ..... 340/638 X 5,010,438 4/1991 Brady ..... 340/638

*Primary Examiner*—Jeffery A. Hofsass

*Attorney, Agent, or Firm*—Edwin H. Paul; Jerry Cohen

[57] ABSTRACT

A circuit breaker arranged with overload sensing, switches and LED indicators. Provided is a green LED (42) which when lit indicates that the circuit is blown and so the electrical wires from the breaker are not powered—the wires are "dead"; a red LED is also provided to indicate, when lit, that the electrical wires are powered or "live", in addition there is an amber third LED (52) which, when lit, indicates that a short circuit overload is still connected to the breaker output terminals.

3 Claims, 1 Drawing Sheet

CIRCUIT BREAKER WITH INDICATOR LIGHTS

FIELD OF THE INVENTION

The present invention relates to improvements in electric circuit breakers, where the condition of the breaker is indicated, preferably by lights.

BACKGROUND OF THE INVENTION

Electric circuit breakers are common and are generally used in pairs or groups with a handle. The position of the handle typically indicates the status or condition of the breaker. The handle usually has three different positions one at each extreme throw of the handle and an intermediate position between the two extremes. One extreme indicates the breaker is switched on, the other extreme indicates the breaker is switched off and the intermediate position shows when the breaker is "blown". "Blown" is a condition where a short circuit, or near short circuit, occurred and the current flowing through the breaker exceeded the rating of the breaker causing the breaker is open, and so disconnect the power source from the load.

U.S. Pat. No. 4,004,201 issued to Robert DePuy discloses a multi-function solid state trip unit for automatic electric circuit breaker incorporation indicator functions. These indicator functions signal when a short circuit, overload or ground fault occurred. This patent is a complex arrangement where sensitive detection circuits are used to detect the load conditions of the breaker. When a short, overload or ground fault occurs the detection circuits respond and through programmable timing circuits drive SCR's which trip the breaker. These SCR's also are connected to indicators which signal which condition occurred. The patent also discloses a bypass circuit which insures that tripping of the breaker is not jeopardized by failure of the indicators.

A limitation of the DePuy patent is its reliance on complex detection and driving circuits requiring a separate power supply. This extra, complex circuitry adds cost and other reliability considerations. Also the DePuy circuitry is magnetically coupled to the breakers, it is not physically connected to the breaker circuitry so that the actual condition of the lines connected to the breaker may not be shown by the indicators.

U.S. Pat. No. 4,056,816 issued to Raul Guim discloses a "light emitting diode (LED) blown circuit breaker indicator." Here the LED is connected in parallel across the circuit breaker terminals by a separate set of contacts. These contacts are arranged similarly to a single pole double throw switch. These separate contacts are arranged such that when the breaker is not blown these separate contacts are opened and the LED circuit is not powered. When the breaker is blown the main breaker contacts are opened disconnecting the load from the power source. But, in this invention, the separate set of contacts are now made and the LED circuit is connected from the power source to the load. Since the load presumably is a short (since the current was enough to blow the breaker) the LED circuit is completed through the load and the LED is turned on. In this way the LED shows the blown breaker which is an object of the invention. U.S. Pat. No. 4,760,384 issued to Oscar Vila-Mascot shows an improvement on the Guim patent. The improvement is to replace the LED with an active component, a capacitor is shown, so that the power requirements are more controlled than in Guim's circuit. There are other claimed benefit and an alternate arrangement where the light is on when the breaker is not blown and off when the breaker is blown. Both of these patents use a separate set of contacts to complete the circuit for the indicator lights, which adds complexity to the arrangement. Furthermore there is no indication that the load circuit is properly receiving the input power.

U.S. Pat. No. 3,742,402 issued to Ronald Nicol et al., discloses a circuit breaker with an on, off and trip indicator. However in this invention the state of the breaker is determined by differing paths traversed by the breaker arm when the breaker was switched off purposely as compared to an overload which ~blows~ the breaker. In this invention there are in fact two different switches with complex mechanical linkages which are costly and difficult to maintain.

There is a need for a simple, low cost, easy to maintain and manufacture circuit breaker which indicates the state of the breaker.

An object of this invention is to provide a means to indicate the state of a circuit breaker without a costly and complex mechanical design. It is an object of this invention to indicate the state of the breaker, on, switched off and blown or tripped.

It is another object of this invention to indicate the condition of the load circuit, e.g. a short still exists or not.

SUMMARY OF THE INVENTION

The present invention overcomes the costly and complex limitations of the prior art by providing indicators which indicate: when the breaker has been blown (tripped) by an overload or short circuit and the short circuit remains in the load; when the breaker has not blown and the load circuit is receiving the input power through the breaker; and when the breaker is physically in the off position. In addition the indicators which show: the blown condition and the condition of the load circuit, do not rely on any contacts within the breaker.

The blown indicator is a circuit connected in parallel with the main circuit breaker contacts. This indicator is connected from the input power terminal to the load terminal. When the breaker is in the normal, or not blown condition, the main breaker contact creates a short circuit across the indicator. In the preferred embodiment the indicator has an impedance in series with an LED so no current travels though the indicator and it is unlit showing that the breaker has not been blown. Other suitable indicators are fluorescence, incandescent, relays or other equivalent mechanical devices, latching devices or combinations of any of the above.

The load power indicator is connected in parallel across the load terminal of the breaker to the neutral terminal. When the breaker is not blown input power travels through the breaker to the load terminal and appears across the load power ind load power indicator is a high impedance LED and will be lit when the breaker is in the normal not blown condition. When a short circuit occurs in the load circuit or when the breaker is in the off position this indicator will be off.

A third indicator shows when the breaker is in the off or blown position. This indicator is connected from a contact in the breaker, which is connected to the input terminal when the breaker is in the blown or off position, to the neutral terminal of the breaker. When the breaker is blown or in the off position, the input power is connected to this indicator. In the preferred embodiment this indicator is a high impedance LED which is lit in this condition. This indicator will be unlit or off when the breaker is in the normal or unblown condition.

Other objects, features, and advantages will be apparent from the following detailed description of preferred embodiments taken in conjunction with the accompanying drawings in which:

DETAILED DESCRIPTION OF PREFERRED EMBODIMENTS

Figure 1:
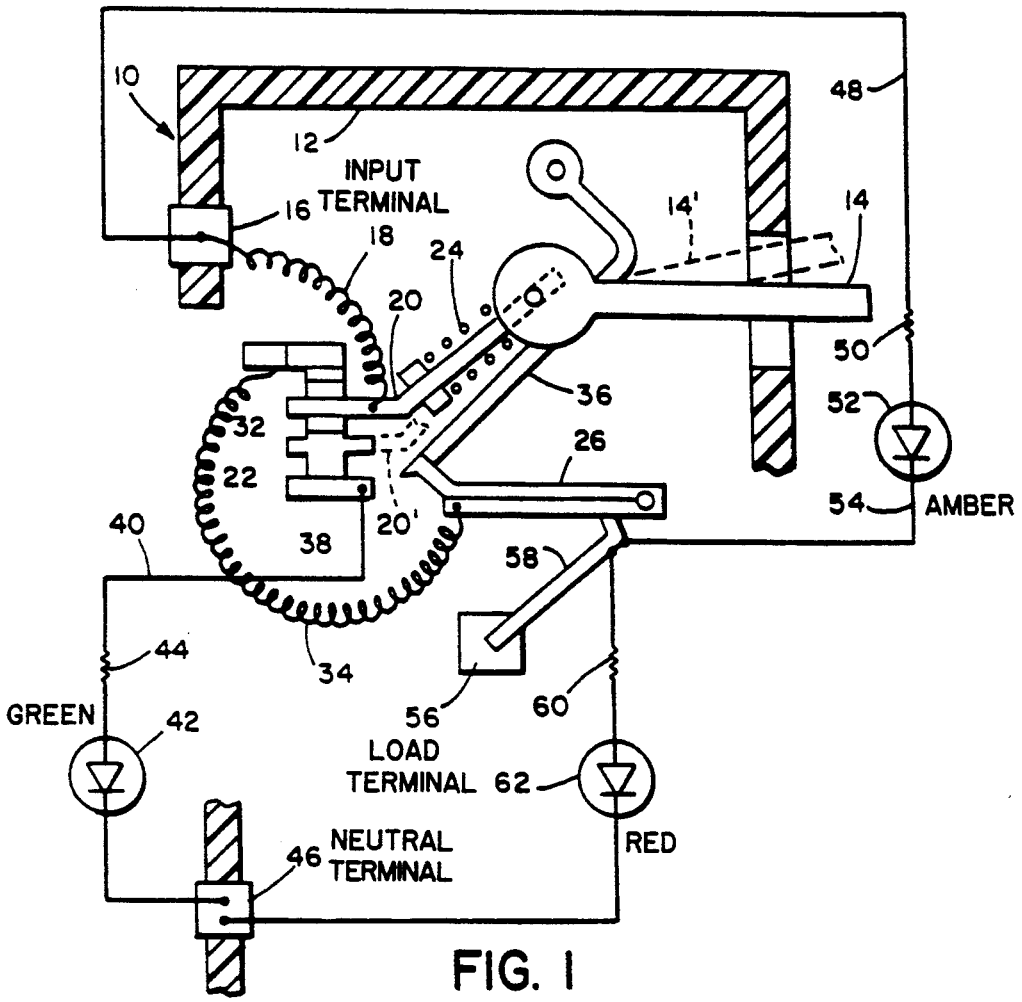
FIG. 1 is a drawing of a circuit breaker with the LED indicators connected.

FIG. 1 shows a typical circuit breaker 10 with a housing 2 which has been broken out to show the internal parts. The housing is preferably made of molded insulating plastic. The active parts of the breaker include a lever 14 (shown in the normal or nor blown position). An input terminal 16 is (which is a higher voltage relative to a neutral terminal of a system in which the breaker 18 used) is connected by flexible conductor 18 to a movable bus bar 20 to which carries a contact 22. A spring 24 is connected at one end to the lever body and presses against the bus bar 20 such that when the lever 14 is in an overload-response position (14'), the spring 24 forces the bar 20 and through the bar the lever further towards the overloaded position. When the lever 14 and the bar 20 are in the normal position the spring 28 presses the bar 20 and the lever 14 further toward the normal position. This mechanism, which is per se conventional, latches the breaker into the overload and normal position.

The terminal 16 is formed to fit into a circuit breaker carrier when many breakers can be conveniently connected.

The breaker includes a current (heat) responsive member 26 (e.g., a bimetal thermostat). In the normal position of bus 20 the terminal 16 is connected to the current responsive member 26 via a flexible conductor 34, via fixed contact 30 and movable contact 22, and flexible conductor 34. The member 26 senses the current in the overload condition and responds by moving a tripping mechanism handle 36 causing the breaker to move to the overload position (14') by working against the spring 24. Bar 20 moves to a corresponding overload position 20'. Once the bar 20 and the 25 handle 14 have moved to their overload positions, the spring 24 causes the breaker mechanism to remain in that position the mechanism is latched.

When in the overloaded position the movable contact 22 electrically connects to a fixed contact 38 and through wire 40 to a high impedance LED-resistor assembly 42 and 44; these two circuit elements will usually be part of one assembly. When the breaker is in the overloaded position there is an electrical connection from the input terminal 16, wire 18, the bar 20 (in position 20'), the movable contact 22, the fixed contact 38, the high impedance indicator shown by the impedance 44 and LED 42, and through a terminal 46 which is the neutral terminal of the system. Here a complete circuit is formed and the LED 42 will be lit. In the preferred embodiment this LED will be green and will indicate that the circuit breaker has been tripped by an overload condition or by manually tripping lever 14.

Figure 2:
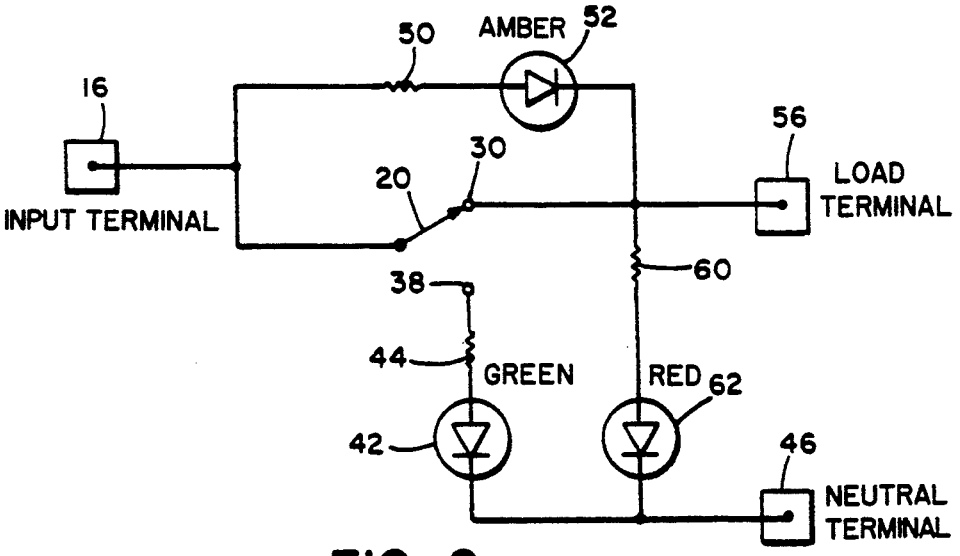
FIG. 2 is a schematic representation of the circuit breaker showing the interconnections of the LEDs and the operable parts of a typical breaker.

An electrical conductor 48 joins the input terminal 16 to a second high impedance 50 and LED 52. The circuit continues from this LED 52 via a conductor 54 to a load terminal 56 and extension bar 58. When the breaker is in the normal position there is a connection from the input terminal 16, the flexible connection 18, the bar 20, the movable contacts 22, the fixed contact 30, the flexible wire 34, device 26 and wire 54. This is an in-parallel connection as shown in FIG. 2, which allows no voltage to occur across the high impedance 50 and LED 52 and the LED 52 will not be lit. But, when in the overloaded condition movable contact 22 is not connected to the fixed contact 30 and a voltage will appear across the high impedance 50 and LED 52. This circuit connection is from the input terminal 16 through the conductor 48 through the high impedance 50 and LED 52 to the load terminal 56. If the overload position occurred because a short circuit occurred in the load circuitry the LED 52 will be lit since the circuit will be completed through this short circuit.

This LED is preferably amber. If the breaker had been actually switched to the overload position using the lever 14 the LED 52 will not be lit if there is no short circuit connected between the load terminal 56 and the neutral terminal 46.

A third high impedance and LED circuit 60 and 62 is connected from the load terminal 56, via bar 58, to the neutral terminal 46. When the breaker is in the normal position the LED 62 will be lit indicating power is being applied between the load terminal 56 and the neutral terminal 46. The circuit providing this power is from the input terminal 16, flexible conductor 18, bar 20, contacts 30 and 32, flexible conductor 34, the current sensing member 26 and the high impedance and LED 60 and 62 to the neutral terminal 46, thus lighting the LED 62. This LED is preferably red. If a short circuit is present in the load circuitry the breaker will latch in the blown position and the movable connector 22 will not be in contact with the fixed contact 30. Thus there will be no completed circuit as just described, the LED 62 will not be lit.

The operation of this invention is with a circuit which uses a bimetal strip as the current sensitive member 26 but an electromagnetic current sensitive member is equivalent in operation.

A truth table showing the status of the conditions of the breaker and the indicating LEDs follows

| CONDITION OF BREAKER | LED 42 (green) | LED 62 (red) | LED 52 (amber) |
|---|---|---|---|
| OVERLOAD (blown) | ON | OFF | ON |
| BREAKER ON NO OVERLOAD | OFF | ON | OFF |
| MANUALLY OFF NO OVERLOAD | ON | OFF | OFF |
| MANUALLY OFF* OVERLOAD | ON | OFF | ON |

*This condition is identical to that shown in the first row. An overloaded (blown) condition with the overload still connected will be identical to a manually switched off condition with an overload connected.

The colors indicated above indicate these states: RED—the breaker is on and the electrical wires connected to this breaker are powered (hot, live). Green indicates the breaker is off— either blown or manually switched—the electrical wires connected to the breaker are "dead", and amber indicates there is a short or overload in the load circuit connected to the breaker.

The above described breaker is shown in circuit diagram form in FIG. 2.

It will not be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. In a circuit breaker having a movable contact connected to an input terminal, said movable contact mounted on a contact arm movable between a closed position directly contacting a fixed contact and an open position away from said fixed contact, a neutral terminal, a load terminal from which a load circuit extends through said fixed and said movable contacts during normal conditions and disconnected from said first contact during an overload condition caused by a short circuit condition in the load circuitry, a tripping mechanism including an overload circuit responsive member connected between the movable contact and the load terminal, said tripping mechanism senses the presence of an overload condition, through the overload circuit responsive member to disconnect, by moving said contact arm, said fixed contact from said movable contact; the improvement comprising:

a first blown circuit indicator connected from said input terminal to said load terminal, said blown circuit indicator connected in parallel with said fixed and said movable contacts, said contact arm and said tripping mechanism such that said indicator shows when said circuit breaker has tripped due to an overload short circuit in the load circuitry, said indicator having the full power input voltage across said indicator through said input terminal and through said overload short circuit when said circuit breaker is in the overload condition, a second indicator connected from said load terminal to said fixed contact, said second indicator showing when said circuit breaker is in the normal—not overloaded—condition, said second indicator having the full power input voltage across said second indicator through said input terminal, through said movable and said fixed contacts and through said neutral terminal, said second indicator showing that said input power is received at said load terminal.

2. A circuit breaker as in claim 1 wherein said breaker further comprises:

a second fixed contact which connect to said movable contact when said breaker is in the overload condition, a third indicator connected from said second fixed contact to said neutral terminal, said third indicator shows when said breaker is in the overload condition and has the full input voltage across said third indicator through said input terminal, through said movable contact and through said second fixed contact and through said neutral terminal.

3. A breaker as in claim 2 wherein said indicators are high impedance LEDs which emit light when a voltage of 50 to 250 volts are across said LED's.

* * * * *